US009580151B2

(12) United States Patent
Cesario

(10) Patent No.: US 9,580,151 B2
(45) Date of Patent: Feb. 28, 2017

(54) VESSEL ANCHORING SYSTEM AND METHOD OF USE

(71) Applicant: Lucas Cesario, Cape Coral, FL (US)

(72) Inventor: Lucas Cesario, Cape Coral, FL (US)

(73) Assignee: L&M DESIGNS, INC., Hillsboro Beach, FL (US)

( * ) Notice: Subject to any disclaimer, the term of this patent is extended or adjusted under 35 U.S.C. 154(b) by 0 days.

(21) Appl. No.: 14/793,378

(22) Filed: Jul. 7, 2015

(65) Prior Publication Data

US 2015/0367916 A1 Dec. 24, 2015

Related U.S. Application Data

(63) Continuation-in-part of application No. 13/244,632, filed on Sep. 25, 2011, now Pat. No. 9,073,609.

(51) Int. Cl.

| | |
|---|---|
| ***B63B 21/26*** | (2006.01) |
| ***B63B 21/24*** | (2006.01) |
| ***B63B 21/29*** | (2006.01) |

(52) U.S. Cl.

CPC ..... *B63B 21/26* (2013.01); *B63B 21/24* (2013.01); *B63B 21/29* (2013.01); *B63B 2221/20* (2013.01)

(58) Field of Classification Search

CPC ..... B63B 21/00; B63B 21/24; B63B 21/26; B63B 21/22; B63B 21/50; B63B 21/48; B63B 21/30; B63B 21/02

USPC ..... 114/230.13, 230.16, 294, 295

See application file for complete search history.

(56) References Cited

U.S. PATENT DOCUMENTS

| | | | | |
|---|---|---|---|---|
| 3,377,977 A * | 4/1968 | Malm | B63B 35/7933 440/13 |
| 6,220,197 B1 * | 4/2001 | Pohlman | B63B 21/26 114/294 |
| 9,073,609 B2 * | 7/2015 | Cesario | B63B 21/26 |

* cited by examiner

*Primary Examiner* — Lars A Olson

(74) *Attorney, Agent, or Firm* — The Concept Law Group, P.A.; Scott D. Smiley; Erin A. Martin

(57) ABSTRACT

An anchoring system for a vessel comprising an anchoring rod, a first support member coupled to a vessel and selectively couplable to the anchoring rod, and a second support member coupled to the vessel and in a spaced relation to the first support member. The second support member retaining the anchoring rod in a slideable engagement and defining a rotation path of the anchoring rod.

20 Claims, 11 Drawing Sheets

VESSEL ANCHORING SYSTEM AND METHOD OF USE

CROSS-REFERENCE TO RELATED APPLICATION

This application is a continuation-in-part of U.S. application Ser. No. 14/220,015, filed Mar. 19, 2014, which claims priority to U.S. application Ser. No. 13/244,632, filed Sep. 25, 2011, the entirety of which is incorporated by reference.

FIELD OF THE INVENTION

This invention relates to an apparatus that can anchor a boat and allow the user to keel the boat.

BACKGROUND OF THE INVENTION

U.S. Pat. No. 7,861,661 to Beaty discloses an "Anchoring system for a kayak." The abstract provides:

Apparatus is disclosed for anchoring a kayak to the bottom of a body of shallow water. The apparatus includes first and seconds tubes for attachment to the kayak proximate the upper portion of the kayak between the bow and the stern of the kayak, and first and second shafts which are disposed in the proximate seat which comprises two sets of gearing mechanisms for operative engagement with the two shafts, and a rotatable handle which is external to the gear box for operative connection to the first and second gearing mechanisms. First and second actuation devices external to the gear box are provided which have first and second positions, and, in the first position, the actuation devices function to establish operative connection between the first and second gearing mechanisms and a rotatable handle.

This invention requires a gear box and crank to deploy two tubes with shafts attached to each end. The applicant's invention has a simple, single shaft design which swivels about a fixed axis.

U.S. Pat. No. ,827,927 to Kivi discloses an "Anchoring system for watercraft vessels." The abstract provides:

An anchoring system for a watercraft vessel, the anchoring system including an anchor bracket configured to be mountable on the watercraft vessel; a sleeve, the sliding tube being at least partially hollow and having a first end and a second end, a rod having a first end disposed within a sliding tube lumen and a second end having a floor contacting tip; the floor contacting tip operable to penetrate the bottom of a creek, lake, river or ocean flat and a retraction member connected to the rod. The retraction member is configured to retract the rod into the sliding tube and retract the sliding tube through the sleeve. It is positioned on the front, rather than at hand's reach. The goal of this invention is to provide an anchor that enters the water silently and does not drag or snag on the bottom of the body of water.

U.S. Pat. Nos. 7,270,072 and 7,270,073 to Waldrop discloses a "Florida anchor." The abstract of U.S. Pat. No. 7,270,072 provides:

An anchor system designed to quickly anchor and release a boat in shallow water with minimal effort and little to no distraction from other activities such as fishing, which has an anchor sleeve containing a sleeve liner through which an anchor pole with a pointed bottom end passes through, said anchor pole extending below the hull of a boat into the lake or river bottom beneath, and which anchor pole can engage a locking insert when the anchor pole is twisted in either direction, said locking insert located in a notch cutout of the top of the sleeve liner, allowing the anchor to be locked in a stowed position, and which has an upper flange which engages a hand grip wrapped around the top of the anchor pole, preventing the top end of the anchor pole from dropping completely through the boat hull, and which has a bottom flange attached to the boat hull bottom through which the anchor pole passes, and which has an attaching nut which attaches the anchor sleeve to the boat deck.

The object of this invention is to provide a quick and easy way for boat operators to anchor their boats. The most specific use is for boats which have a trolling motor. The design is a single shaft which can be deployed into the water and also stowed in a vertical position on the side of the boat, however, this design is vertical at all times.

U.S. Pat. No. 6,092,484 to Babin et al. discloses a "Marine anchor system." The abstract provides:

An improved anchor is provided for small boats for mooring in the bottom of bodies of water such as lakes and coastal and inland waters. Embodiments include an anchor comprising a rod, such as a round cross-section stainless steel rod about 3-6 feet long and about 1-2 inches in diameter. One end of the rod is tapered, either to a point or to a blunt hemispherical end, while the other end has a swivel with an eyelet for connecting a shackle rope or chain. A hand grip is provided on the rod between the two ends of the rod. The tapered end of the rod is inserted into the bottom of a body of water using the hand grip. Thus, the anchor easily sets on the first attempt, the swivel accommodates changes in current and wind conditions that may move the boat while it is moored, thereby avoiding dislodging of the anchor and the anchor does not snag on debris.

Here, the user either grips the pole and inserts it into the water or throws it into the water like a spear. Furthermore, one end is attached to a rope or chain which is fixed to the boat. The design allows the boat to swivel about the fixed end in order to accommodate for changes in current and prevent the anchor from dislodging.

U.S. Pat. No. 6,220,197 to Pohlman discloses an "Anchoring and operating device for a watercraft." The abstract provides:

A device for operating and anchoring in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole.

This invention utilizes a rod with telescoping sections which can easily be extended for use as an anchor or to walk a boat along hazardous conditions. It can then be retracted and stowed in a vertical position. This invention utilizes a spud assembly to lock the rod into place at the desired length.

SUMMARY OF THE INVENTION

With the foregoing and other objects in view, there is provided, in accordance with the invention, an anchoring system for a vessel comprising an anchoring rod, a first support member coupled to a vessel and selectively couplable to the anchoring rod, and a second support member coupled to the vessel and in a spaced relation to the first support member. The second support member retains the anchoring rod in a slideable engagement and defines a rotation path of the anchoring rod.

In accordance with a further feature of the present invention, the first support member comprises a retention member for selectively coupling the anchoring rod to the first support member.

In accordance with a further feature of the present invention, the anchoring system comprises a track securing at least one of the first support member and the second support member to the vessel and allowing adjustment of the spaced relation thereof.

In accordance with a further feature of the present invention, the anchoring rod physically couples the vessel to a piece of earth when the second support member rotates in relation to the first support member.

In accordance with a further feature of the present invention, the second support member is rotatable in relation to the first support member.

In accordance with a further feature of the present invention, the anchoring rod comprises a first end disposed a distance from a second end, the second end including a sharp end engageable into a piece of earth.

In accordance with a further feature of the present invention, the slideable engagement includes a bungee cord.

In accordance with a further feature of the present invention, the first support member and second support member are coupled to a side of the vessel.

In accordance with a further feature of the present invention, an anchoring system for a vessel comprises a first support member coupled to the side of a vessel, an anchoring rod coupled to the first support member and operable to pivot around the first support member when the anchoring rod is rotated by a user, and a first retention member coupled to the first support member. The first support member is operably configured to retain the anchoring rod in a stowed position on the side of the vessel.

In accordance with a further feature of the present invention, the anchoring system further comprises a second support member coupled to the side of the vessel and disposed a distance from the first support member. A second retention member is coupled to the second support member, the second retention member operably configured to retain the anchoring rod in a stowed position on the side of the vessel.

In accordance with a further feature of the present invention, the anchoring rod physically couples the vessel to a piece of earth when the second support member rotates in relation to the first support member.

In accordance with a further feature of the present invention, the second support member is rotatable in relation to the first support member.

In accordance with a further feature of the present invention, the anchoring rod comprises a first end separated from a second end by an elongated body, the second end including a sharp end engageable into a ground surface.

In accordance with a further feature of the present invention, the anchoring system comprises at least one track defining an elongated aperture sized and shaped to receive at least a piece of the first support member within the elongated aperture.

In accordance with a further feature of the present invention, the first support member comprises a first end and a second end separated by a body length, and the anchoring rod is sized and shaped to engage the first support member along the body length.

In accordance with a further feature of the present invention, a method of anchoring a vessel comprises providing an anchoring system including an anchoring rod, a first support member coupled to a vessel and selectively couplable to the anchoring rod, and a second support member coupled to the vessel and in a spaced relation to the first support member, the second support member retaining the anchoring rod in a slideable engagement and defining a rotation path of the anchoring rod. The method includes selectively decoupling the anchoring rod from the first support member, rotating the anchoring rod along the rotation path, and physically coupling the vessel to a piece of earth by rotating the second support member in relation to the first support member.

In accordance with a further feature of the present invention, the method of anchoring a vessel comprises providing a retention member for selectively coupling the anchoring rod to the first support member.

In accordance with a further feature of the present invention, the method of anchoring a vessel comprises providing a track securing at least one of the first support member and the second support member to the vessel and allowing adjustment of the spaced relation thereof.

In accordance with a further feature of the present invention, the method of anchoring a vessel comprises providing the anchoring rod having a first end disposed a distance from a second end, the second end including a sharp end engageable into the piece of earth.

In accordance with a further feature of the present invention, the method of anchoring a vessel comprises providing the first support member and the second support member coupled to a side of the vessel.

Although the invention is illustrated and described herein as embodied in a vessel anchoring system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the vessel from a stern to a bow.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
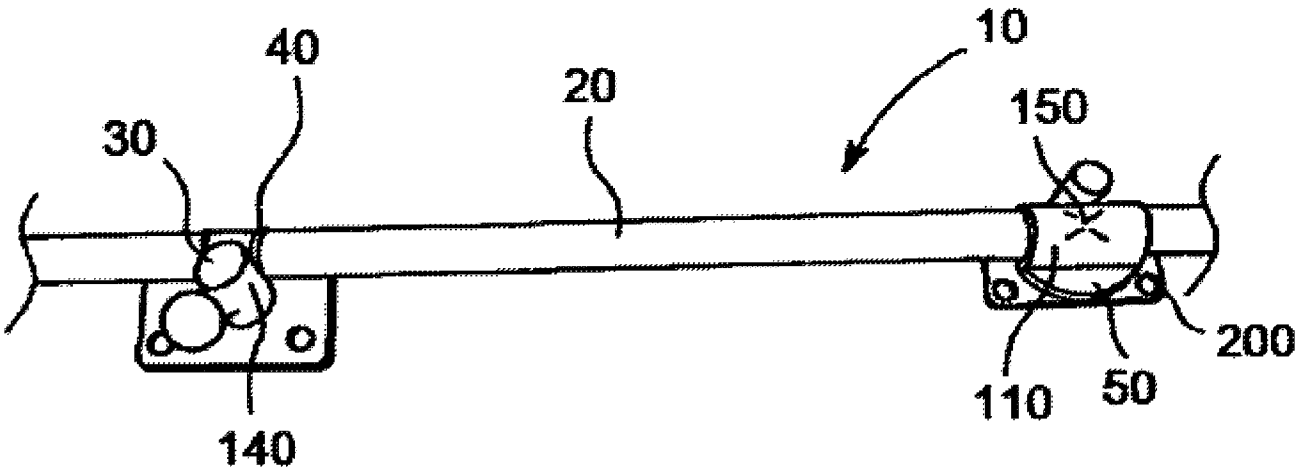
FIG. 1 is a pictorial view of one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to, "secured to," or similar language includes the definitions "indirectly connected to," "directly connected to," "indirectly secured to," and "directly secured to."

Figure 4:
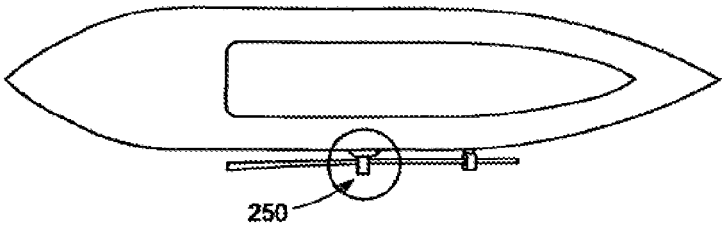
FIG. 4 is another pictorial view of one embodiment of the present.

As seen in FIG. 1, the present invention 10, also called an anchor and keel apparatus 10, discloses an anchor and keel apparatus 10 for a watercraft, such as a boat. The anchor and keel apparatus 10 may be a single shaft 20, also referred to as a member 20, which may terminate at a second end 110, as best seen in FIG. 4. The second end 110 may have a point-shaped end 120 or a screw-shaped end 130 for the purpose of embedding into the bottom of a body of water.

The anchor and keel apparatus 10 may be slidably disposed within a collar 190. The collar 190 that may be integral with a member pivoting means 50 so that the collar 190 can rotate or pivot about a first axis 150. The collar 190 may be rotatably disposed on a base 200 of the member pivoting means 50.

The member 20, when not in use, may be stowed in a substantially horizontal position using a member retention means 30, such as a flexible cord secured to the hull, and can extend over the member 20 and attach to an extension 140 that extends outwardly from hull or vessel. A ball may be attached to the flexible cord, and this type of member retention means 30 may be called a flexible cord and ball system 40. The member retention means 30 may hold the member 10 in contact with the extension to prevent the member 10 from moving.

The flexible cord and ball system 40 can easily be unwrapped, and the member 10 may then pivot or swivel about a fixed axis 150 for deployment into the water.

FIG. 1 also illustrates an embodiment of the member pivoting means 50 which may be secured to the side of a hull of a water craft. The member pivoting means 50 may rotate about a first axis 150, which may be substantially perpendicular with respect to the member 20, so that the member 20 may rotate about the first axis 150. This way the member 20 can be moved from its stowed position when it is secured to the member retention means 30, to any appropriate angle so that the member 20 can contact the bottom surface of a body of water, such as a lake, or anchoring or keeling purposes.

The member pivoting means 50 may be able to be secured at a variety of angular positions via a lock and lock release 60. In one embodiment, the lock and lock release 60 may comprise a pin that is biasly forced toward the hull, so as to be able to be set in a lock pin aperture 170 or several pin apertures 170 to set themember pivoting means 50 at a desired position. For example from the stowed position, when the member 20 is oriented substantially horizontal, the member pivoting means 50 may be rotated about 90 degrees, so that the member 20 is now oriented substantially vertical so that the second end 110 or ground penetration means 70 may be disposed in the ground to anchor the vessel.

Figure 2:
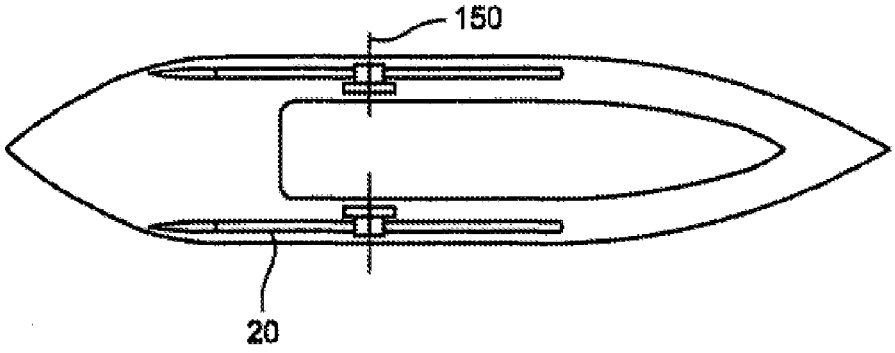
FIG. 2 is another pictorial view of one embodiment of the present invention.
Figure 3:
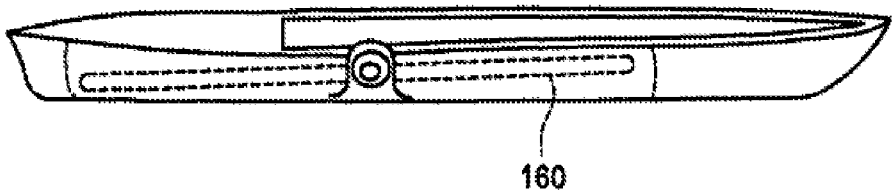
FIG. 3 is another pictorial view of one embodiment of the present.

FIGS. 2 and 3 illustrate an embodiment of the member pivoting means 50, which may rotate about a first axis 150. The first axis 150 may extend horizontally away from or through the vessel, to allow the member 20 to be rotated in a clockwise, or counter clockwise direction.

FIG. 1 illustrates an embodiment of the collar 190 of the present invention 10. The member pivoting means 50 may have a base 200 that is secured to the hull of a vessel. A collar 190 may be rotatably disposed on the base 200 so the collar may rotate upon a first axis 150.

FIGS. 2 and 3 illustrate an embodiment of the present invention 10 whereby the member 20 is disposed in a channel 160 within the hull to allow the member 20 to pivot clockwise, or counter clockwise about a first axis 150.

Figure 5:
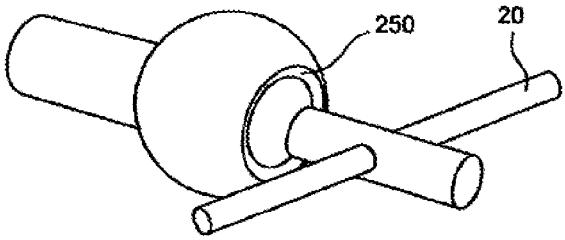
FIG. 5 is another pictorial view of one embodiment of the present.

FIGS. 4 and 5 illustrates one embodiment of the member pivoting means 50 whereby the member pivoting means 50 is a ball and socket joint 250 that can allow the member 20 to pivot in an array of directions.

Figure 6:
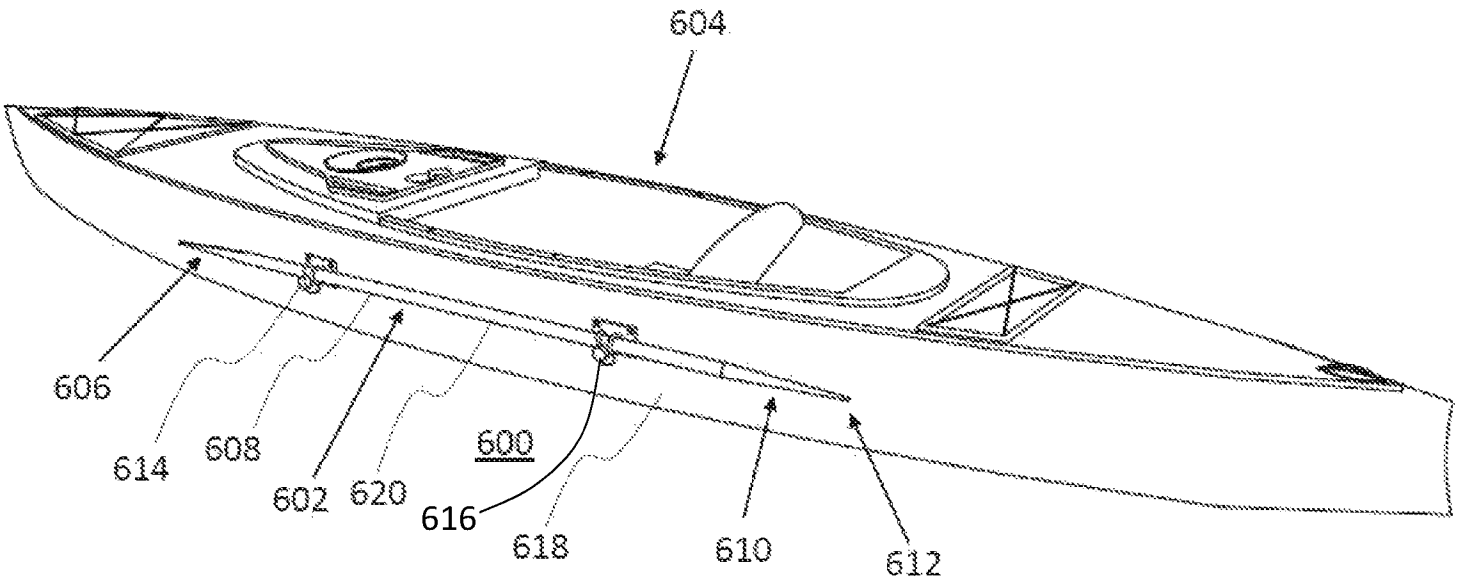
FIG. 6 is a perspective view of an anchoring system for a vessel shown coupled to the vessel in accordance with an embodiment of the present invention.

With reference now to FIG. 6, one embodiment of an anchoring system for a vessel 604, i.e., anchoring system 600, is shown in a perspective view. The vessel is defined herein in its broadest possible sense and may include a kayak, boat, jet ski, or other mobile apparatus that may be anchored to a piece of earth. Advantageously, the anchoring system 600 provides a user with the ability to rotate an anchoring rod 602 coupled to a vessel 604, in order to secure the anchoring rod 602 into a piece of earth. The user can thereafter easily an conveniently maneuver the position of the anchoring rod 602, while keeping the anchoring rod 602 secured to the vessel 604, to avoid the risk of losing the anchoring rod 602. In one embodiment, the anchoring system 600 may be coupled to a side 618 of the vessel 604. In another embodiment, the anchoring system 600 may be coupled to a top deck of the vessel 604 and thereafter moved to an outside portion of the vessel 604. In other embodiments, the anchoring system 600 may be coupled, without limitation, to other portions of the vessel, e.g., the hull, bow, stern, etc. The anchoring system 600 may be coupled to the vessel by, without limitation, a mounting bracket and/or track system, as understood by a person of ordinary skill in the art.

In one embodiment, the anchoring rod 602, which may be referred to herein as a member 20, includes a first end 606 disposed a distance 608 from a second end 610. The distance 608 may vary according to the overall length of the anchoring rod 602 and the vessel 604. The first end 606 may include a sharp end or may be interchangable with a non-sharp end. In one embodiment, the second end 610 may include a sharp end 612, e.g., the pointed-shaped end 120 or a screw-shaped end 130, engageable into a piece of earth. In other embodiments, the second end 610 may be a non-sharp end or may be interchangeable with the sharp end 612. The piece of earth is defined herein in its broadest possible sense and may include the bottom of a body of water. The anchoring rod 602 may include an elongated body 620 spanning the distance 608 from the first end 606 to the second end 610. The term elongated is defined as having a length as least twice as long as a width.

With reference still to FIG. 6, in one embodiment, the anchoring system 600 includes a first support member 614 coupled to the vessel 604 and selectively couplable to the anchoring rod 602. The first support member 614 may be in a spaced relation from a second support member 616. In one embodiment, the second support member 616 retains the anchoring rod 602 in a slideable engagement with respect to the first support member 614. In use, the first support member 614 may be decoupled from the vessel 604, while the second support member 616 defines a rotation path of the anchoring rod 602 as the anchoring rod 602 is moved from a position coupled to the first support member 614 to the position engaging the earth. Said another way, the second support member 616 is rotatable in relation to the first support member 614. In one embodiment, the anchoring rod 602 pivots around the second support member 616 when the anchoring rod 602 is rotated by a user. In one embodiment, the first support member 614 may be the only support member within the anchoring system. In this embodiment, the anchoring rod 602 can be said to pivot around the first support member 614. In other embodiments, the first support member 614 may be the second support member 616 and vice versa.

Figure 7:
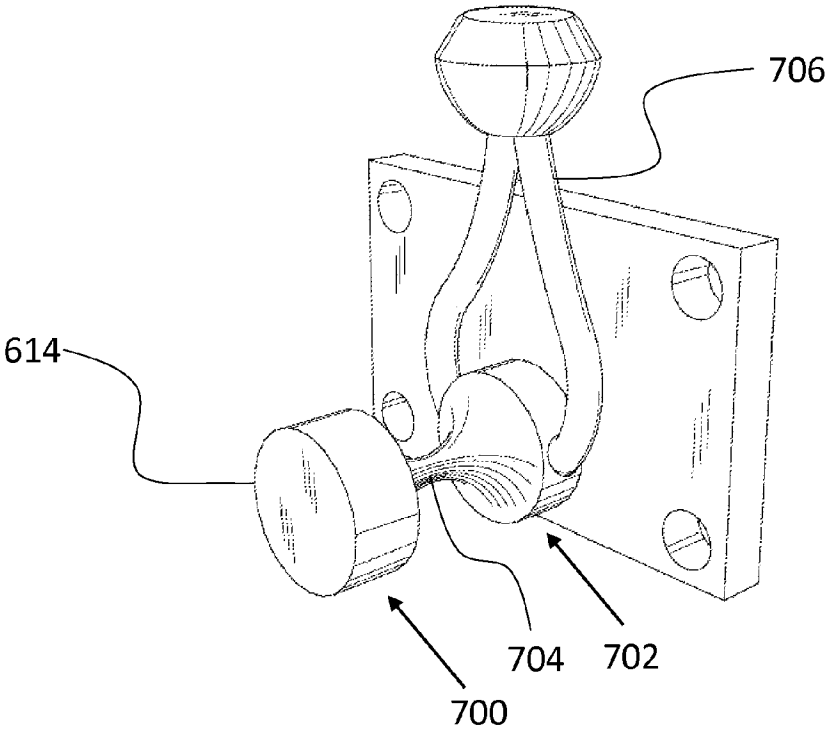
FIG. 7 is a perspective view of a support member shown in an assembled configuration in accordance the anchoring system of FIG. 6.
Figure 8:
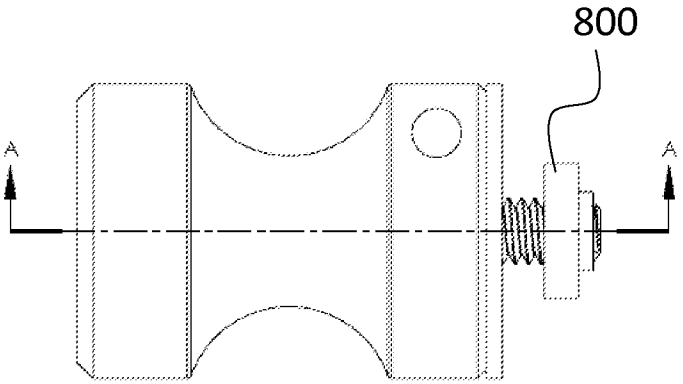
FIG. 8 is a perspective view of the support member of FIG. 7.
Figure 9:
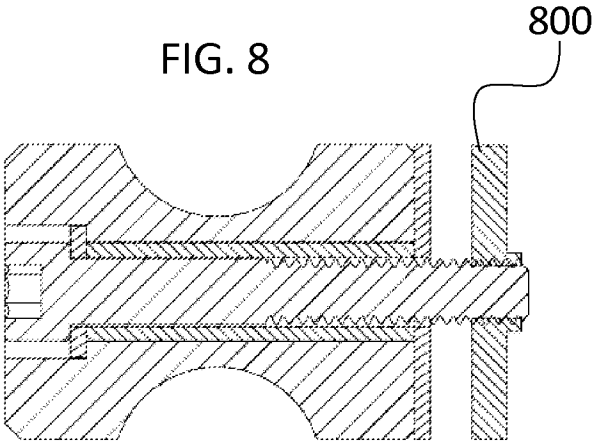
FIG. 9 is a cross-sectional view of the support member of FIG. 8 taken along section A-A.
Figure 10:
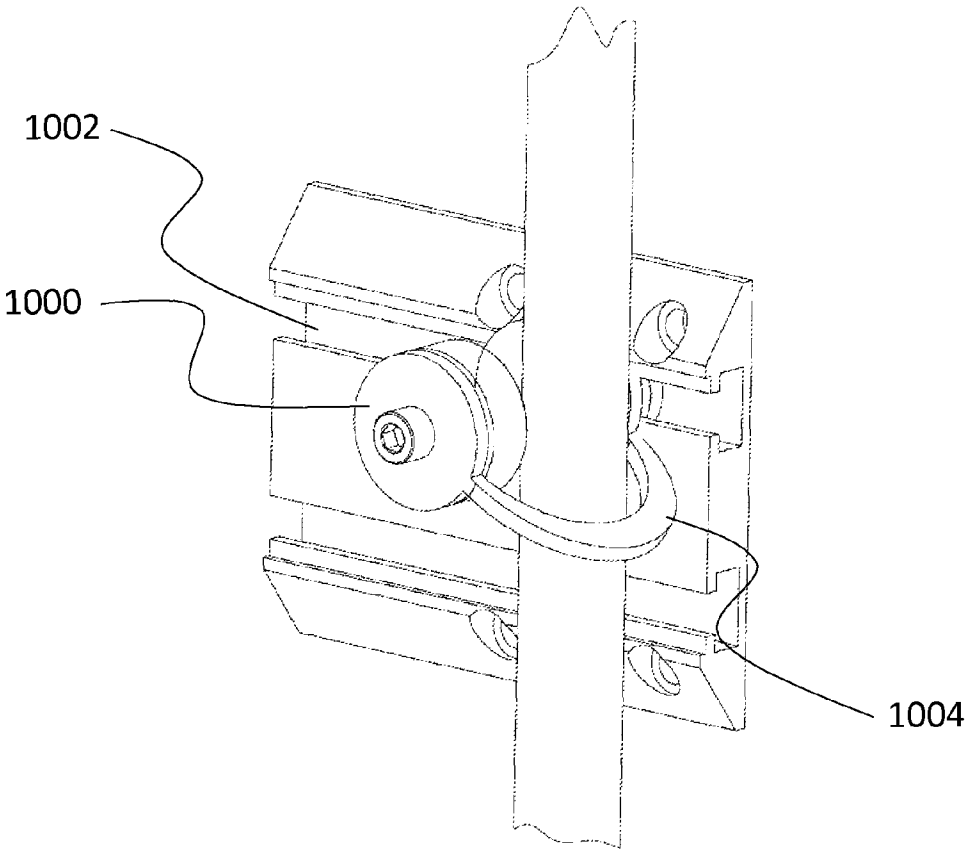
FIG. 10 is a perspective view of a support member in accordance with another embodiment of the present invention.

With brief reference to FIG. 6, in conjunction with FIGS. 7-9, the first support member 614 may be, without limitation, a metal fastener, a plastic fastener, etc., and may or may not include a screw 800 (FIGS. 8 and 9) coupled thereto for rotational movement. In one embodiment, the first support member 614 may be a fastener having a first end 700 and a second end 702 separated by a body length 704. The anchoring rod 602 may be sized and shaped to engage the first support member 614 along the body length 704.

Figure 11:
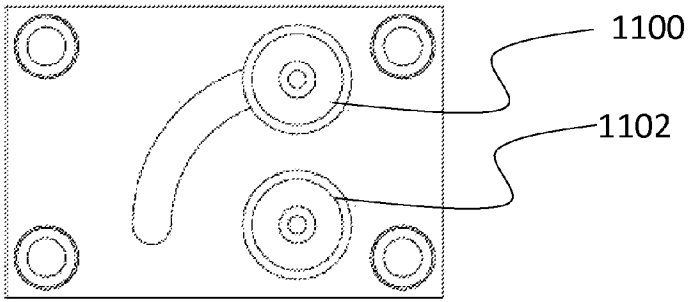
FIG. 11 is a perspective view one embodiment of a support member and a retention member in accordance with another embodiment of the present invention.
Figure 12:
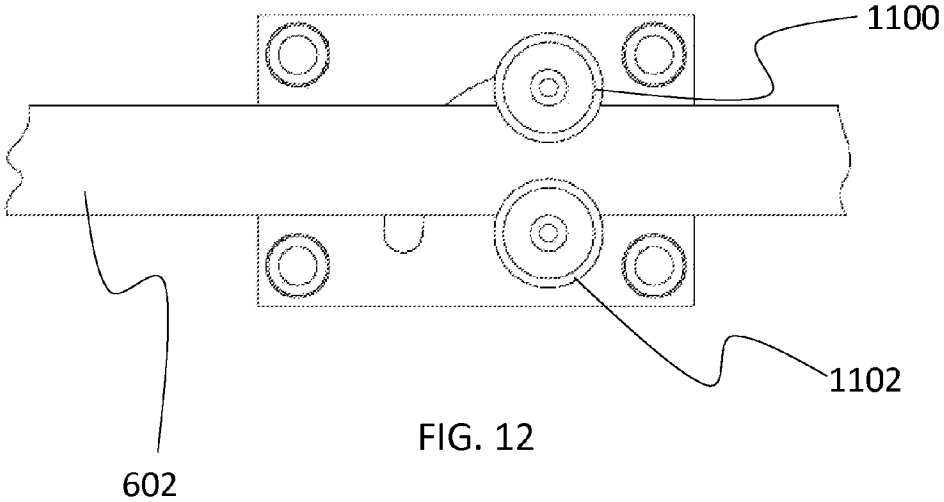
FIG. 12 is a perspective view of the support member and the retention member of FIG. 11 showing an anchoring rod inserted therethough.
Figure 13:
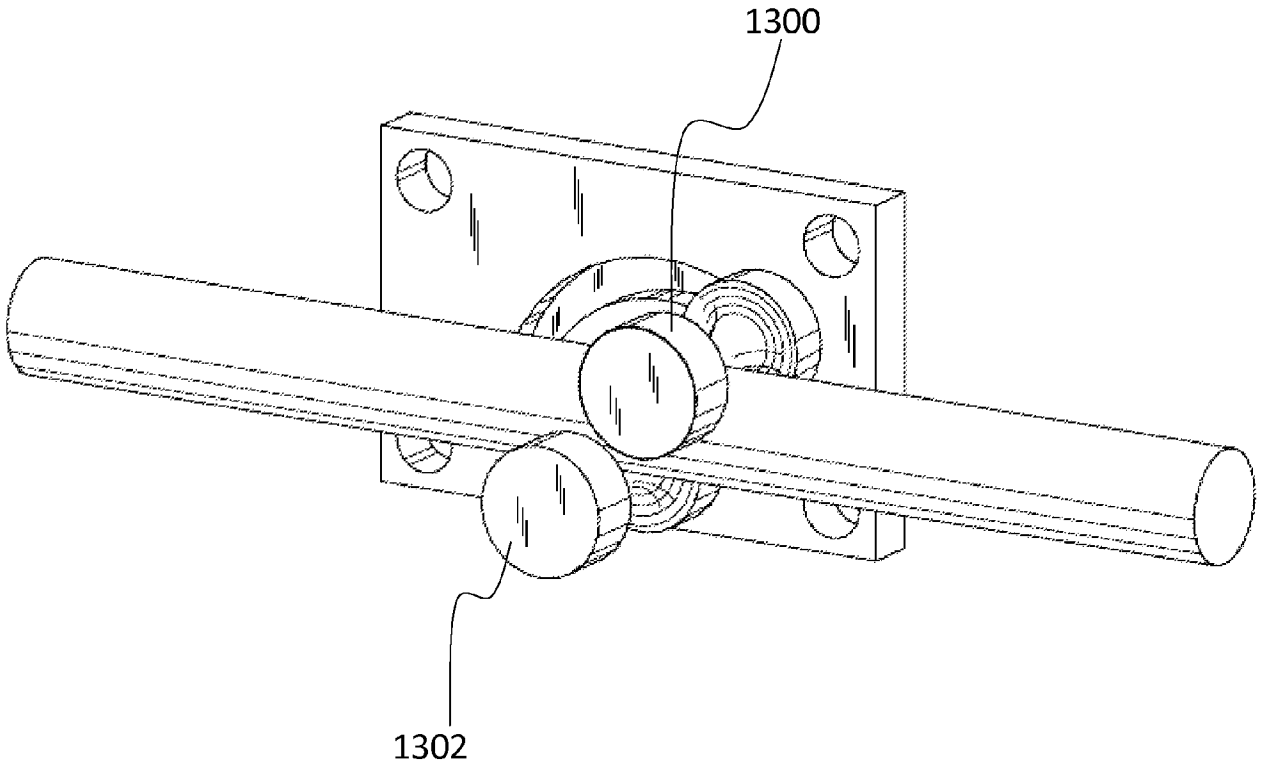
FIG. 13 is a perspective view of an alternative embodiment of a support member and a retention member in accordance with another embodiment of the present invention.

The slideable engagement may be accomplished through the use of the first support member 614 and/or a retention member 706 (FIG. 7) selectively coupling the anchoring rod 602 to the first support member 614. FIG. 7 depicts the retention member 706 as a bungee cord. In another embodiment, with brief reference to FIG. 10, a retention member 1004 is shown as a hook-like member configured to substantially surround a support member 1000. This configuration creates a binding effect to retain pressure or friction along the anchoring rod 602. In one embodiment, the support member 1000 and the retention member 1004 together function similar to that of a caulk gun. FIGS. 11-12 depict a retention member 1100 as a fastener configured to apply pressure to the anchoring rod 602 to retain the anchoring rod 602 between the retention member 1100 and a support member 1102. In one embodiment, as depicted in FIG. 13, a retaining member 1300 is depicted as being the same type of fastener as a support member 1302. The embodiments shown in FIGS. 7-13 are exemplary embodiments and not meant to limit the features disclosed herein.

Figure 14:
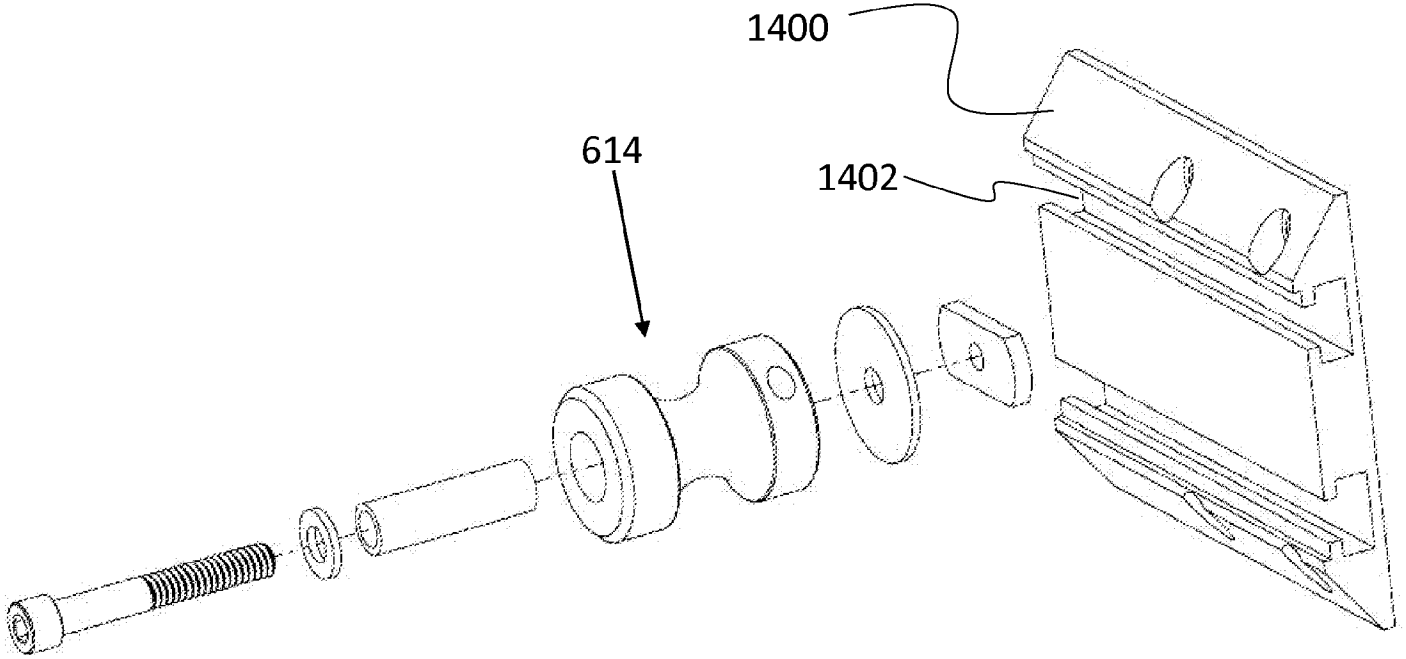
FIG. 14 is a perspective view of a track in accordance with another embodiment of the present invention.

With reference again to FIG. 10, the support member 1000 is depicted slideably engaged with a track 1002. In one embodiment, the track 1002 secures at least one of the first support member 614, 1000 and a second support member 616 (FIG. 6) to the vessel 604, allowing adjustment of the spaced relation between the first support member 614 and the second support member 616. Advantageously, a user can adjust the spaced relation according to the user's size and preference when using the vessel 604. In another embodiment, a single track may extend a length of the vessel 604. With brief reference to FIG. 14, an alternative embodiment of a track 1400 is shown in conjunction with the first support member 614. The track 1400 defines an elongated aperture 1402 for receiving the first support member 614 therein. The anchoring system 600 may include one or more tracks.

Figure 15:
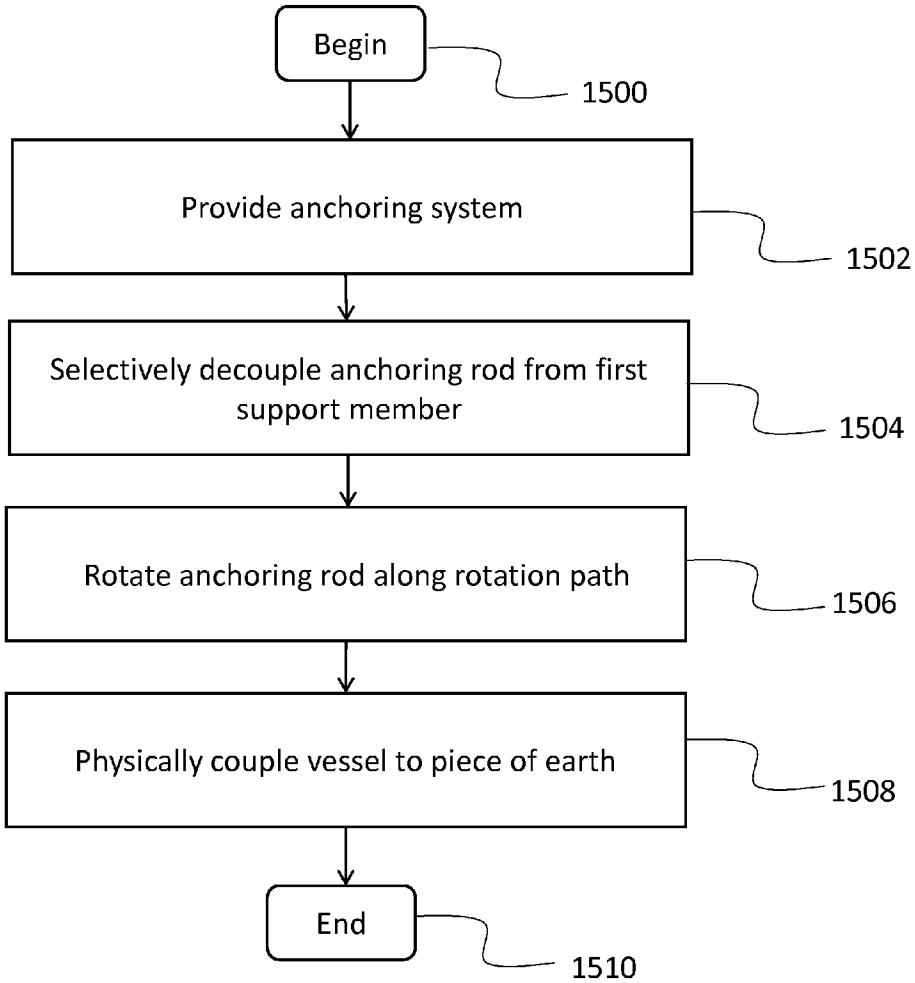
FIG. 15 is an exemplary flow diagram of a method of anchoring a vessel.

Referring now to FIG. 15, in conjunction with FIGS. 6-14, there is provided an exemplary process-flow diagram depicting a method of anchoring a vessel. The steps delineated in the exemplary process-flow diagram of FIG. 15 are merely exemplary of the preferred order of anchoring the vessel, and said steps may be carried out in another order, with or without additional steps included therein.

In said process, the method begins as step 1500 and immediately proceeds to the step 1502 of providing, e.g., bringing into physical existence, an anchoring system, such as the anchoring system 600 described above. In one embodiment, the anchoring system 600 may include an anchoring rod, a first support member coupled to a vessel and selectively couplable to the anchoring rod, and a second support member coupled to the vessel and in a spaced relation to the first support member. The second support member may retain the anchoring rod in a slideable engagement and may define a rotation path of the anchoring rod. In one embodiment, the first support member and the second support member are coupled to a side of the vessel. The method may include providing a track for securing at least one of the first support member and the second support member to the vessel and allowing adjustment of the spaced relation thereof.

The present method continues to step 1504 of selectively decoupling the anchoring rod from the first support member. The anchoring system 600 may or may not include a retention member for selectively coupling the anchoring rod to the first support member. In step 1506, the anchoring rod is rotated along the rotation path. In one embodiment, the method continues to step 1508 of physically coupling the vessel to a piece of earth by rotating the second support member in relation to the first support member. In one embodiment, the anchoring rod includes a first end disposed a distance from a second end. The second end may include a sharp end engageable into the piece of earth. The method ends at step 1510.

It should be understood, of course, that the foregoing relates to exemplary embodiments of the invention and that modifications may be made without departing from the spirit and scope of the invention as set forth in the following claims.

What is claimed is:

1. An anchoring system for a vessel comprising:
an anchoring rod;
a first support member coupled to a vessel and selectively couplable to the anchoring rod; and
a second support member coupled to the vessel and in a spaced relation to the first support member, the second support member retaining the anchoring rod in a slideable engagement and defining a rotation path of the anchoring rod, the rotation path including the anchoring rod disposed in a stowed position along a longitudinal direction of the vessel.

2. The anchoring system according to claim 1, wherein the first support member further comprises:
a retention member for selectively coupling the anchoring rod to the first support member.

3. The anchoring system according to claim 1, further comprising:
a track securing at least one of the first support member and the second support member to the vessel and allowing adjustment of the spaced relation thereof.

4. The anchoring system according to claim 1, wherein:
the anchoring rod physically couples the vessel to a piece of earth when the second support member rotates in relation to the first support member.

5. The anchoring system according to claim 1, wherein:
the second support member is rotatable in relation to the first support member.

6. The anchoring system according to claim 1, wherein the anchoring rod further comprises:
a first end disposed a distance from a second end, the second end including a pointed end engageable into a piece of earth.

7. The anchoring system according to claim 1, wherein:
the slideable engagement includes a bungee cord.

8. The anchoring system according to claim 1, wherein:
the first support member and the second support member are coupled to the side of the vessel.

9. An anchoring system for a vessel comprising:
a first support member couplable to a side of a vessel;
an anchoring rod couplable to the first support member and operable to pivot around the first support member from when the anchoring rod is rotated by a user; and
a first retention member coupled to the first support member, the first retention member operably configured to retain the anchoring rod in a longitudinal stowed position with respect to a longitudinal dimension of the vessel.

10. The anchoring system according to claim 9, further comprising:
a second support member coupled to the side of the vessel and disposed a distance from the first support member; and
a second retention member coupled to the second support member, the second retention member operably configured to retain the anchoring rod in a stowed position on the side of the vessel.

11. The anchoring system according to claim 10, wherein:
the anchoring rod physically couples the vessel to a piece of earth when the second support member rotates in relation to the first support member.

12. The anchoring system according to claim 10, wherein:
the second support member is rotatable in relation to the first support member.

13. The anchoring system according to claim 9, wherein the anchoring rod further comprises:
a first end separated from a second end by an elongated body, the second end including a pointed end engageable into a piece of earth.

14. The anchoring system according to claim 9, further comprising:
at least one track defining an elongated aperture sized and shaped to receive at least a piece of the first support member within the elongated aperture.

15. The anchoring system according to claim 9, wherein the first support member further comprises:
a first end and a second end separated by a body length; and
the anchoring rod is sized and shaped to engage the first support member along the body length.

16. A method of anchoring a vessel comprising:
providing an anchoring system including:
an anchoring rod;
a first support member coupled to a vessel and selectively couplable to the anchoring rod; and
a second support member coupled to the vessel and in a spaced relation to the first support member, the second support member retaining the anchoring rod in a slideable engagement and defining a rotation path of the anchoring rod;
selectively decoupling the anchoring rod from the first support member when the anchoring rod is disposed in a longitudinal stowed position with respect to a longitudinal dimension of the vessel;
rotating the anchoring rod along the rotation path; and
physically coupling the vessel to a piece of earth by rotating the second support member in relation to the first support member.

17. The method of claim 16 further comprising:
providing a retention member for selectively coupling the anchoring rod to the first support member.

18. The method of claim 16 further comprising:
providing a track securing at least one of the first support member and the second support member to the vessel and allowing adjustment of the spaced relation thereof.

19. The method of claim 16 further comprising:
providing the anchoring rod having a first end disposed a distance from a second end, the second end including a pointed end engageable into the piece of earth; and
physically coupling the pointed end to the piece of earth.

20. The method of claim 16 further comprising:
providing the first support member and the second support member coupled to a side of the vessel.

* * * * *